United States Patent [19]

Haupt

[11] Patent Number: 4,462,770

[45] Date of Patent: Jul. 31, 1984

[54] GEAR PUMP WITH ROTATABLE SECTIONS

[75] Inventor: Fritz Haupt, Regensdorf, Switzerland

[73] Assignee: Maag Gear Wheel & Machine Company Limited, Zürich, Switzerland

[21] Appl. No.: 462,428

[22] Filed: Jan. 31, 1983

[30] Foreign Application Priority Data

Feb. 19, 1982 [CH] Switzerland ..... 1037/82

[51] Int. Cl.[3] ..... F01C 1/18

[52] U.S. Cl. ..... 418/39; 418/206

[58] Field of Search ..... 418/205, 206, 39; 417/315, 360, 361

[56] References Cited

U.S. PATENT DOCUMENTS

| | | | |
|---|---|---|---|
| 2,278,110 | 3/1942 | Kinnucan | 418/39 |
| 2,310,078 | 2/1943 | Herman | 418/39 |
| 2,492,687 | 12/1949 | Dall | 418/39 |
| 2,655,108 | 10/1953 | Osborne | 418/39 |
| 2,665,636 | 1/1954 | Lauck | 418/39 |
| 3,294,029 | 12/1966 | Clark | 418/39 |
| 4,225,296 | 9/1980 | Haupt | 418/206 |

*Primary Examiner*—Leonard E. Smith
*Assistant Examiner*—Jane E. Obee
*Attorney, Agent, or Firm*—Werner W. Kleeman

[57] ABSTRACT

A pump housing containing an inlet and an outlet and enclosing two meshing pumping gear wheels is connected through an intermediate bearing plate to a transmission housing comprising a base arrangement and enclosing two meshing auxiliary gear wheels. An end bearing plate is disposed on the side of the transmission housing which is remote from the pump housing. The two bearing plates and the transmission housing are designed to be mutually mounted with respect to one another in four relative rotational positions, each rotated by 90° with respect to a primary axis of the gear pump. The pump housing and the intermediate bearing plate are designed to be mutually fastened to each other in two relative rotational positions, each rotated with respect to one another by 180° about the primary axis.

5 Claims, 3 Drawing Figures

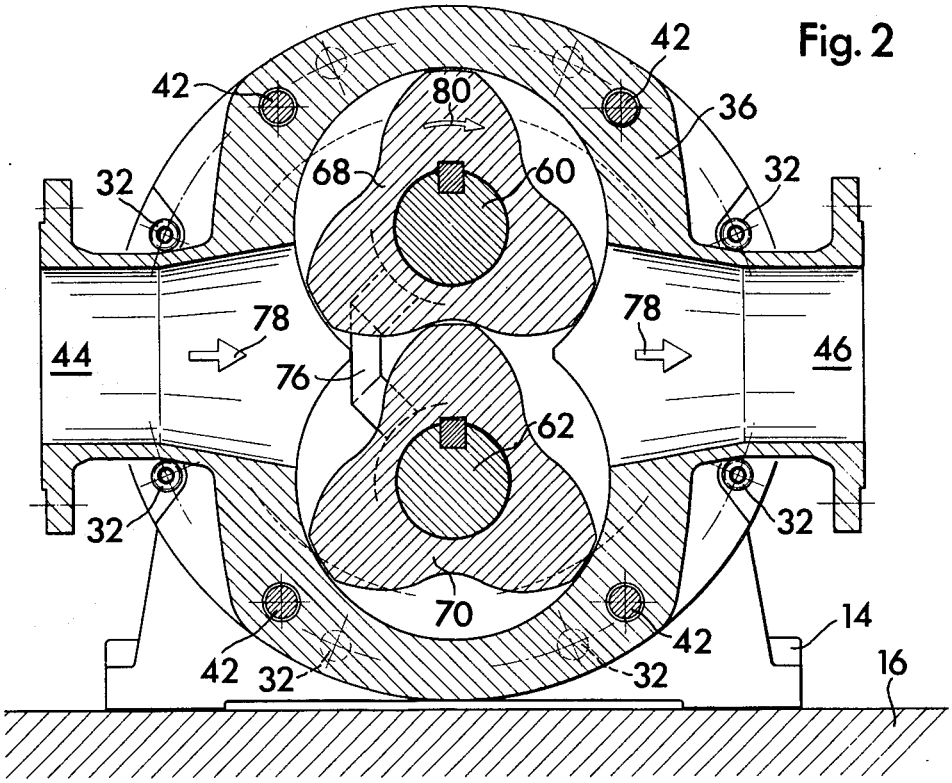
Fig. 2
Fig. 3
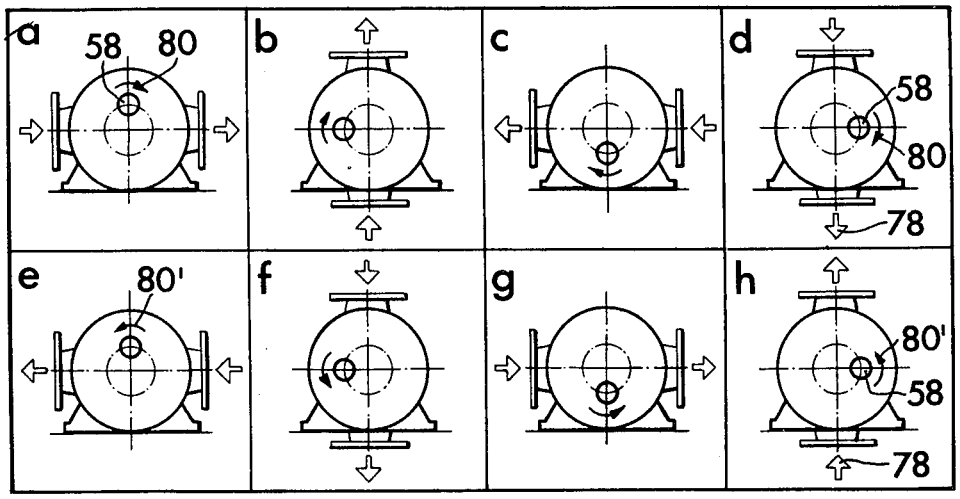

GEAR PUMP WITH ROTATABLE SECTIONS

BACKGROUND OF THE INVENTION

The present invention relates to a new and improved construction of gear pump.

In its more particular aspects, the gear pump of the present development is of the type comprising a pump housing having an inlet and an outlet and two meshing pumping gear wheels enclosed by the pump housing. There are also provided a transmission housing including a base arrangement and two meshing auxiliary gear wheels enclosed in the transmission housing. The pump housing and the transmission housing define a common primary axis. An end bearing plate is disposed on the side of the transmission housing which is remote from the pump housing and an intermediate bearing plate is disposed intermediate the pump housing and the transmission housing. Two shafts are arranged symmetrically in respect of the primary axis and are rotatably journaled in the end bearing plate and in the intermediate bearing plate. One of the two shafts forms a driving shaft. Each of the two shafts carries a respective one of the pumping gear wheels and one of the auxiliary gear wheels and an outwardly protruding shaft stud or journal is provided at the driving shaft.

In a gear pump as known, for example, from U.S. Pat. No. 4,225,296, the end bearing plate is formed in one-piece with the transmission housing and is provided with two bearing bores, in each of which one of the two shafts is journaled. Consequently, the arrangement of the two shafts with respect to the transmission housing is established once and for all. The pump housing is bolted to the transmission housing through the intermediate bearing plate and is also designed such that the once established mutual positional correlation of pump housing and transmission housing thereafter no longer can be changed. Therefore, the suction and pressure lines intended to be connected to such prior art gear pump have to be adapted to the installation position of the gear pump as governed by the position of the base arrangement of the transmission housing.

SUMMARY OF THE INVENTION

Therefore, with the foregoing in mind it is a primary object of the present invention to provide a new and improved gear pump which can be adapted with only small effort to predetermined arrangements of suction and pressure lines intended to be connected thereto.

Now in order to implement this and still further objects of the invention, which will become more readily apparant as the description proceeds, the gear pump of the present development is manifested by the features that, the end bearing plate and the intermediate bearing plate as well as the transmission housing are structured to be mounted to each other in at least two relative rotational positions rotated with respect to one another by a substantially uniform angle relative to the primary axis of the gear pump; and the pump housing and the intermediate bearing plate are structured to be mounted to each other in two relative rotational positions rotated with respect to one another by an angle of approximately 180° about the primary axis of the gear pump.

In a preferred embodiment of the gear pump according to the invention, the two bearing plates are fastened to the transmission housing by threaded bolts or screws which are accessible for release and tightening without having to release the connection of the pump housing with the intermediate bearing plate.

Furthermore, the pump housing is expediently fastened to the intermediate bearing plate by threaded bolts or screws or equivalent structure which may be released while the intermediate bearing plate remains fastened to the transmission housing.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 is a cross-sectional view taken substantially along the line II—II of FIG. 1; and FIG. 3 encompassing FIGS. 3*a* to 3*h* is a schematic illustration of the various arrangements of the gear pump according to the invention composed in different ways of the components or structure shown in FIGS. 1 and 2.

DETAILED DESCRIPTION OF THE PREFERRED EMBODIMENTS

Figure 1:
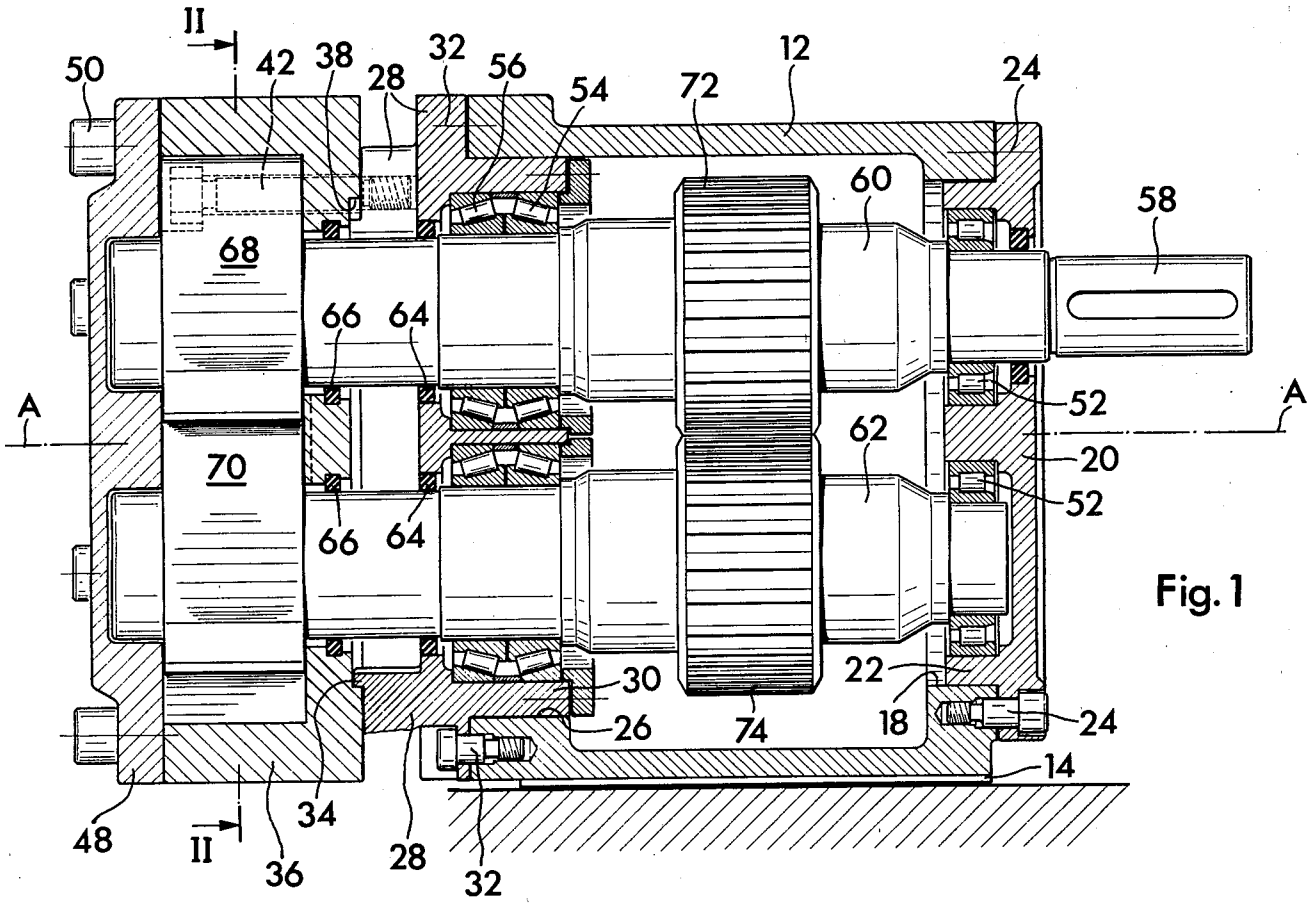
FIG. 1 is an axial sectional view through the gear pump constructed according to the invention.

Describing now the drawings, it is to be understood that only enough of the construction of the gear pump and related structure has been shown as needed for those skilled in the art to readily understand the underlying principles and concepts of the present development, while simplifying the showing of the drawings. Turning attention now specifically to FIG. 1, there has been illustrated an axial section through an exemplary embodiment of gear pump according to the invention. The gear pump has a transmission housing 12 including a base or pedestal arrangement 14. The transmission housing 12 forms an essential load-bearing or load-supporting member of the gear pump. The base arrangement 14 is designed so as to be fastened to a suitable support 16. Depending upon the arrangement and design of the support 16 the position in space of the transmission housing 12 is thus established. From such positional establishment or fixation there results the desire to adapt the arrangement of other pump components, as will be described hereinbelow, to the varying installation conditions which are encountered in practise.

At one of its ends, which is the right-hand end in FIG. 1, the transmission housing 12 comprises a first circular, substantially cylindrical interior face or surface 18 at which there is centered an end bearing plate 20 by means of a substantially cylindrical collar 22 formed at the end bearing plate 20 and having a substantially cylindrical outer face. The end bearing plate 20 is releasably but securely fastened to the transmission housing 12 by a number of threaded bolts or screws 24 or equivalent fastening expedients, one of which is designed as a fit-bolt or screw as shown at the right-hand bottom portion of FIG. 1.

At the other one of its ends, which forms the left-hand end in FIG. 1, an also circular, substantially cylindrical interior face or surface 26 is provided at the transmission housing 12, and an intermediate bearing plate 28 is centered thereat by means of a substantially cylindrical collar 30 formed at the intermediate bearing plate 28. The intermediate bearing plate 28 is fastened to the transmission housing 12 by means of threaded bolts or screws 32 or the like, one of which, again, is designed as a fit-bolt or screw as shown at the bottom of FIG. 1.

The two circular, substantially cylindrical interior faces or surfaces 18 and 26 define a common axis which, in the following disclosure is termed the primary or main axis A of the gear pump.

The threaded bolts or screws 24 and 32 and the associated threaded holes or bores in the transmission housing 12 are disposed in such a way that after releasing the threaded bolts 24 and 32 the two bearing plates 20 and 28 may be rotated by 90° or any desired multiple thereof about the primary axis A. By again tightening the threaded bolts 24 and 32 the two bearing plates 20 and 28 are again fastened to the transmission housing 12.

The intermediate bearing plate 28 contains at its end, which is the left-hand end in FIG. 1, and which end is remote from the transmission housing 12, a further collar 34 which is of substantially circular cylindrical shape on its exterior side or outer surface. A pump housing 36 includes a circular, substantially cylindrical interior face or surface 38 and is centered at the collar 34 by means thereof. The pump housing 36 is fastened to the intermediate bearing plate 28 by means of threaded bolts or screws 42 which terminate in the intermediate bearing plate 28 and which are arranged such that the pump housing 36 may be selectively fastened to the intermediate bearing plate 28 in any one of two relative rotational positions each rotated with respect to one another by 180° about the primary axis A.

As best seen by referring to FIG. 2, the pump housing 36 comprises an inlet 44 and an outlet 46, and is closed by means of a cover 48 which is fastened to the pump housing 36 by means of threaded bolts or screws 50 as shown in FIG. 1.

A driving shaft 60 provided with a drive stud or journal 58 as well as a driven shaft 62 are journaled or rotatably mounted in the end bearing plate 20 and in the intermediate bearing plate 28 by means of cylindrical roller bearings 52 and conical roller bearings 54 and 56, respectively. The two shafts 60 and 62 piercingly extend through seals 64 and 66 arranged in the intermediate bearing plate 28 and in the pump housing 36, respectively. Meshing pumping gear wheels 68 and 70 are fastened to the two shafts 60 and 62, respectively, within the pump housing 36. Auxiliary gear wheels 72 and 74 are fastened to the shafts 60 and 62, respectively, within the transmission housing 12. The auxiliary gear wheels 72 and 74 also mesh with one another and are adjusted such that the pumping gear wheels 68 and 70 are held interengaged without contacting each other.

To relieve the seals 66 the pump housing 36 contains a relief groove 76 or the like formed on the suction side thereof adjacent to the pump inlet 44. The pump housing 36 thus is not of a completely symmetrical design with respect to the vertical central plane extending normally with respect to the plane of the drawing of FIG. 2. It is primarily for this reason that the direction of through-flow of the pumped medium through the pump housing 36, as indicated by arrows 78, will always have to be observed. The rotational direction of the shafts 60 and 62, which is indicated by an arrow 80 in FIG. 2, is not permitted to be reversed at one and the same arrangement of the pump housing 36 relative to the other components or parts of the gear pump.

In FIGS. 3*a* to 3*h* different arrangements of the sub-assemblies, which are rotatable with respect to one another about the primary axis A, in the gear pump as described hereinbefore are illustrated, the viewing direction in each case being from the left to the right of FIG. 1. In all arrangements which have been illustrated, the transmission housing 12 assumes the same position in space in which the base arrangement 14 is directed downwardly.

FIG. 3*a* shows an arrangement corresponding to the detailed illustration shown in FIGS. 1 and 2. In this case the inlet 44 is on the left-hand side and the outlet 46 is on the right-hand side. The drive stud 58 is located at the top and is driven in the direction of the arrow 80, so that the delivery or feed of the gear pump is from the left to the right.

According to FIG. 3*b*, the entire sub-assemblies of the gear pump which are rotatable about the primary axis A have been rotated, after releasing the threaded bolts 24 and 32, counter-clockwise by 90° relative to the transmission housing 12 in comparison to FIG. 3*a*, without the threaded bolts 42 and 50 having to be unscrewed therefor. Now, the pump inlet 44 is located at the bottom, the pump outlet 46 at the top and the drive stud 58 on the left-hand side, so that the gear pump delivers upwardly with the rotational direction unchanged as indicated by the arrow 80.

FIG. 3*c* shows the result of a further common rotation of the entire sub-assemblies, which are rotatable about the primary axis A, by another 90° relative to the transmission housing 12. Now, the pump inlet 44 is located on the right-hand side, the pump outlet 46 on the left-hand side, and the drive stud 58 at the bottom so that the gear pump with the driving rotational direction unchanged as indicated by the arrow 80, delivers from the right to the left.

FIG. 3*d* shows the pump inlet 44 at the top, the pump outlet 46 at the bottom and the drive stud 58 on the right-hand side. Thus, now all the changes possible without readjustment of the pump housing 36 with respect to the two bearing plates 20 and 28 have been exhausted.

If now the arrangement as shown in FIG. 3*a* is intended to be modified in such a way that the pump delivers from the right to the left instead of from the left to the right but with the drive stud 58 remaining at the top, then, the gear pump will have to be assembled in such a way that the bearing plates 20 and 28 retain their arrangement as shown in FIGS. 1 and 2, but the pump housing 36, however, as compared to the arrangement shown in FIGS. 1 and 2 as well as in FIG. 3*a*, is rotated by 180° about the primary axis A. The result thereof is shown in FIG. 3*e*. The drive stud 58 which has been driven clockwise in the direction of the arrow 80 according to FIG. 2 and FIGS. 3*a* to 3*d* now will have to be driven in the opposite direction, i.e. counter-clockwise in the direction of the arrow 80', in order to further suck-up the medium to be delivered through the pump inlet 44 and to discharge the same through the pump outlet 46.

The arrangements according to FIGS. 3*f* to 3*h* again result from the arrangement illustrated in FIG. 3*e* by rotating the two bearing plates 20 and 28 including the shafts 60 and 62 journaled therein together with the pump housing 36 in steps of 90° each about the primary axis A, the new driving rotational direction indicated by the arrow 80' being retained.

While there are shown and described present preferred embodiments of the invention, it is to be distinctly understood that the invention is not limited thereto, but may be otherwise variously embodied and practiced within the scope of the following claims. ACCORDINGLY, What I claim is:

1. A gear pump comprising a pump housing having a pump inlet and a pump outlet;

two meshing pumping gear wheels enclosed by said pump housing;

a transmission housing including a base arrangement;

two meshing auxiliary gear wheels enclosed in said transmission housing;

said pump housing and said transmission housing defining a common primary axis;

an end bearing plate disposed on a side of said transmission housing which is remote from said pump housing;

an intermediate bearing plate disposed intermediate said pump housing and said transmission housing;

said end bearing plate and said intermediate bearing plate as well as said transmission housing being structured to be mounted to each other in at least two relative rotational positions rotated with respect to one another by a substantially uniform angle relative to said primary axis;

said pump housing and said intermediate bearing plate being structured to be mounted to each other in two relative rotational positions rotated with respect to one another by an angle of approximately 180° about said primary axis;

two shafts arranged symmetrically in respect of said primary axis and rotatably journaled in said end bearing plate and in said intermediate bearing plate, one of said shafts forming a driving shaft;

each of said two shafts carrying one of said two pumping gear wheels and one of said two auxiliary gear wheels; and an outwardly protruding drive stud provided at said driving shaft.

2. The gear pump as defined in claim 1, further including:

threaded bolts for fastening said end bearing plate and said intermediate bearing plate to said transmission housing; and said threaded bolts being accessible for releasing and tightening thereof without said pump housing having to be detached from said intermediate bearing plate.

3. The gear pump as defined in claim 2, further including:

threaded bolts for fastening said pump housing to said intermediate bearing plate; and said threaded bolts being releasable while said intermediate bearing plate remains fastened to said transmission housing.

4. The gear pump as defined in claim 1, further including:

threaded bolts for fastening said pump housing to said intermediate bearing plate; and said threaded bolts being releasable while said intermediate bearing plate remains fastened to said transmission housing.

5. A gear pump comprising:

a pump housing having a pump inlet and a pump outlet;

two meshing pumping gear wheels enclosed by said pump housing;

a transmission housing including a base arrangement;

two meshing auxiliary gear wheels enclosed in said transmission housing;

said pump housing and said transmission housing defining a common primary axis;

an end bearing plate disposed on a side of said transmission housing which is remote from said pump housing;

an intermediate bearing plate disposed intermediate said pump housing and said transmission housing;

said end bearing plate and said intermediate bearing plate as well as said transmission housing being structured to be mounted to each other in at least two relative rotational positions rotated with respect to one another by a substantially uniform angle relative to said primary axis; and said pump housing and said intermediate bearing plate being structured to be mounted to each other in two relative rotational positions rotated with respect to one another by an angle of approximately 180° about said primary axis.

* * * * *